United States Patent [19]

Faiers

[11] 3,960,314

[45] June 1, 1976

[54] COIN BAGS WITH FLIP TOP CLOSURES

[75] Inventor: John Alan Faiers, London, England

[73] Assignee: Decoflex Limited, London, England

[22] Filed: Feb. 22, 1974

[21] Appl. No.: 444,901

[52] U.S. Cl. ..... 229/62; 150/7; 206/.82; 206/260

[51] Int. Cl.[2] ..... B65D 33/16

[58] Field of Search ..... 224/56, 62, 72; 150/7, 150/37; 206/.83, .84, 260

[56] References Cited

UNITED STATES PATENTS

| | | | |
|---|---|---|---|
| 2,709,467 | 5/1955 | Hoeppner | 150/7 |
| 3,015,918 | 1/1962 | Schoen | 229/62 |
| 3,358,906 | 12/1967 | Faiers | 229/62 |
| 3,446,421 | 5/1969 | Carrigan et al. | 229/72 X |
| 3,720,367 | 3/1973 | Rayner et al. | 229/62 |

FOREIGN PATENTS OR APPLICATIONS

| | | | |
|---|---|---|---|
| 1,334,831 | 10/1973 | United Kingdom | 229/62 |
| 1,359,099 | 10/1974 | United Kingdom | 229/62 |
| 962,258 | 7/1964 | United Kingdom | |

*Primary Examiner*—Stephen P. Garbe
*Attorney, Agent, or Firm*—Watson, Cole, Grindle & Watson

[57] ABSTRACT

This invention relates to a bag suitable for containing coins. The bag is made of heat sealable plastics material in order that the customer can see the kind of coins contained in the bag. The bag has a pouch formed adjacent to the mouth of the bag and directed towards the bottom of the bag so that the pouch can be flipped over the mouth of the bag to enclose the mouth. Additionally a back panel is provided with an extended portion so arranged that the extended portion is trapped within the mouth of the bag to form a barrier to prevent coins spilling from the bag.

4 Claims, 14 Drawing Figures

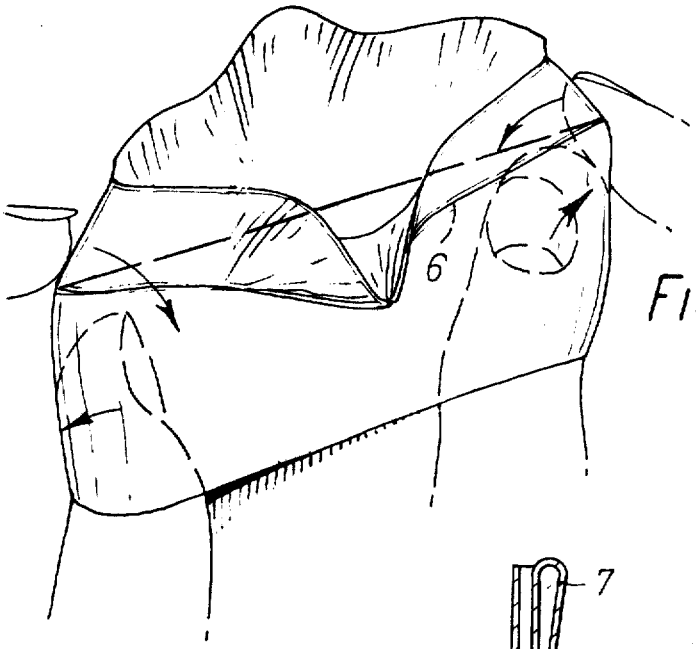
FIG. 4
FIG. 5
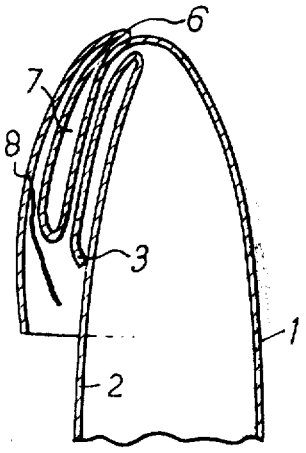
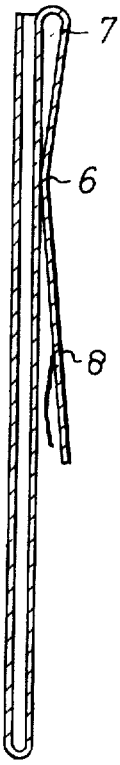
FIG. 6
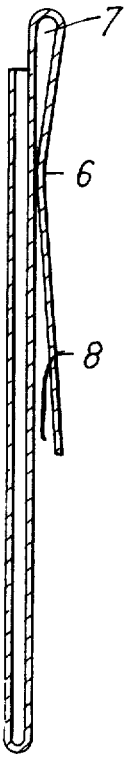
FIG. 7

FIG. 8
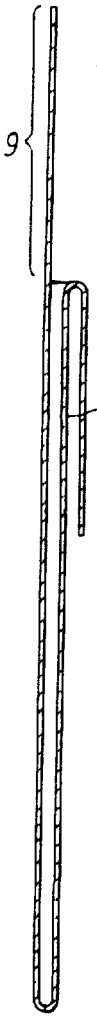
FIG. 9
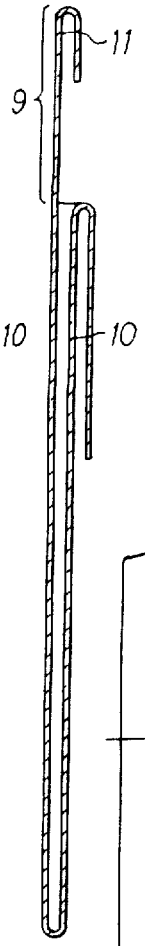
FIG. 10
FIG. 11
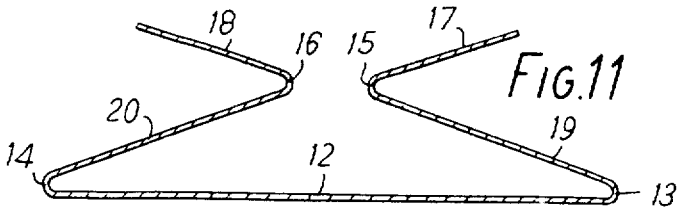
FIG. 12
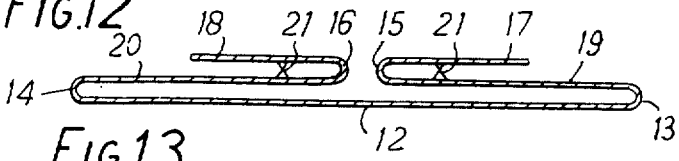
FIG. 13
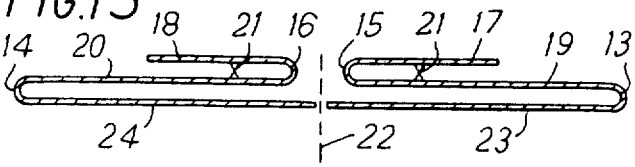
FIG. 14
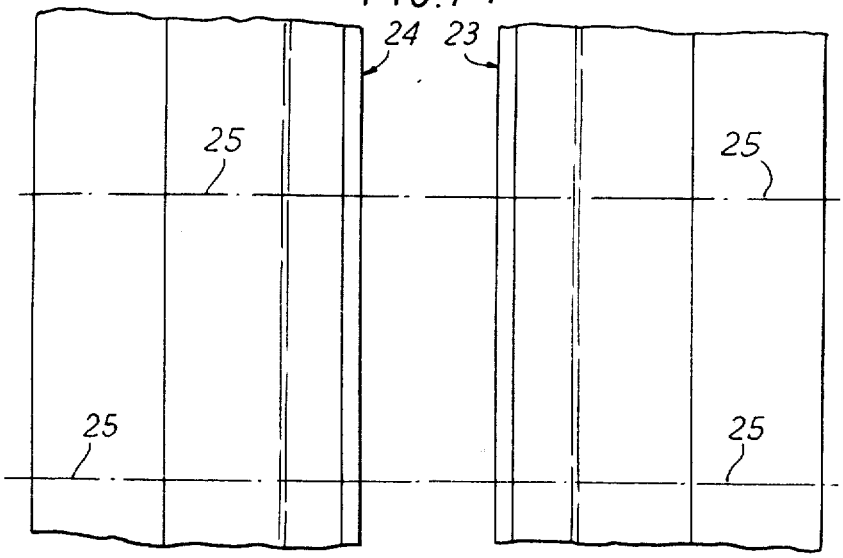

COIN BAGS WITH FLIP TOP CLOSURES

This invention relates to bags and particularly but not exclusively to bags for containing coins.

Coin bags made of heat sealable transparent plastics material have been proposed as a replacement for paper bags traditionally used by banks and commercial businesses. One such proposal is the bag described in British Patent Specification No. 1,072,696. The proposed bag has two spaced pockets, one of which is larger than the other. The larger one of the pockets is filled with coins and the bag is folded in such a manner that the bottom of the filled pocket can be tucked into the smaller pocket. In this manner the coins are contained within an enclosed pack.

In use, the bag has been found to be not entirely satisfactory because some skill and dexterity is required to close the bag after it has been filled and it is costly to manufacture.

An object of the present invention is to provide an improved bag of the type specified herein.

According to the present invention there is provided a bag made of synthetic plastics or like material and having front and back panels sealed together along opposite side margins of the bag, the front panel being folded outwardly upon itself and sealed to the side margins of the bag to form a pouch with the mouth of the pouch directed towards the bottom of the bag. An important feature of the bag is that the back panel is provided with a portion arranged so that when the bag is closed by turning the pouch inside out the portion is trapped to form a barrier within the reversed pouch.

Figure 1:
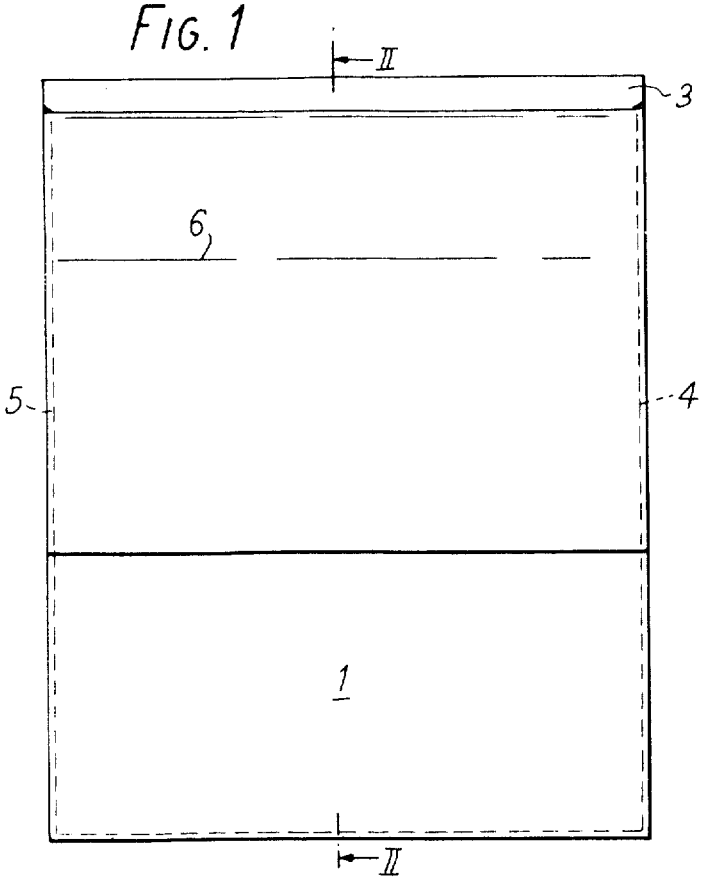
Figure 2:
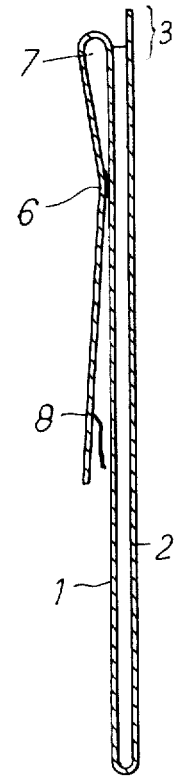
Figure 3:
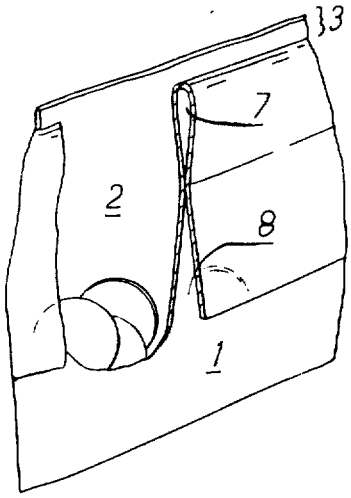

The invention is described, by way of example only, with reference to the accompanying drawings in which:

FIG. 1 is a front view of one example of a bag according to the present invention, FIG. 2 is a cross section of the bag, FIG. 3 is a perspective view of the bag shown partly in cross section and containing coins, FIG. 4 is an illustrative view of the top of the bag when the bag is in the process of being closed, FIG. 5 is a simplified cross section of the top of the bag when the bag is in a closed condition, FIGS. 6 to 9 show, in cross section, further examples of a bag according to the present invention, and, FIGS. 10 to 14 show diagrammatically the steps in a method of manufacturing a bag as shown in FIGS. 1 to 5.

Referring now to FIGS. 1 to 5, a bag is made of synthetic plastics material which is folded to form a front panel 1 and a back panel 2 and in which the front panel is folded outwardly upon itself so that the back panel extends beyond the fold of the front panel to form a rudimentary lip 3. The front panel, including the folded part thereof, and back panel are sealed together along the side margins of the bag as shown at 4 and 5 and the folded part of the front panel is sealed to the adjacent face of the front panel in a weld 6 transversely of the front panel, thereby forming an enclosed part 7 and a pouch 8.

After the bag has been filled with coins, as shown in FIG. 3, it is closed by holding the bag in the position shown in FIG. 1 and then by inserting the right hand thumb into the right hand corner of the pouch 8 and the left hand thumb into the left hand corner of the pouch (as shown in FIG. 4) and folding the pouch 8 and rudimentary lip about weld 6 as is shown in FIG. 5. As the pouch 8 is folded about the weld 6, the enclosed part 7 together with the free end portion of the back panel 2 forms a barrier within a hood formed by reversed pouch 8, which closes the mouth of the bag (as shown in FIG. 5). Upon closing of the bag, part 7 is trapped between the hood formed by the reversed pouch and back panel 2, as shown in FIG. 5. An effective closure of the bag is obtained in this manner since the extra material trapped within the hood and the contact between the folded portions inhibit the formation of a gap in the area of the mouth of the bag due to the weight of the coins.

The lip 3 is a desirable feature because it has been found that it is easier to separate the front and back panel when the lip 3 is present. However, a bag having front and back panels of equal depth (as shown in FIG. 6) would have a barrier formed within the reversed pouch if it were closed in the manner described with reference to FIGS. 4 and 5. But the advantage of having a rudimentary lip could also be achieved by having the depth of the back panel of the bag slightly less than the depth of the front panel so that the rudimentary lip is provided by the upper end of the front panel (as shown in FIG. 7).

The enclosed part 7 of the bag described with reference to FIGS. 1 to 5 and which is also present in the arrangements shown in FIGS. 6 and 7, may be dispensed with if the back panel is extended to provide a free flap (as shown at 9 in FIGS. 8 and 9). Such bags each have a pouch 10 which, when turned inside out, traps the free flap 9 which thereby forms a barrier within a hood formed by the reversed pouch.

The free flap 9 on the bag illustrated in FIG. 9 is folded upon itself and sealed to itself to form a pocket 11. Greater rigidity is given to the free flap 9 when it is provided with a pocket 11 and the enhanced rigidity reduces the tendancy of the flap to fall forwardly when the bag is being filled. When the bag is being emptied, the flow of coins is checked by the pocket 11 thereby preventing the coins from spilling at an uncontrolled rate from the bag.

One method of manufacturing the bag shown in FIGS. 1 to 5 is illustrated in FIGS. 10 to 14.

A sheet of transparent synthetic plastics material 12 is folded by drawing two opposite edges towards one another and then turning them outwardly upon themselves to form two outer folds 13 and 14 and two inner folds 15 and 16 (as shown in FIG. 11). The folds are arranged so that the top layers 17 and 18 (FIG. 11) are of equal area but the areas are smaller than those of the second, or intermediate layers 19 and 20.

The top layers 17 and 18 are heat sealed to the adjacent intermediate layers 19 and 20 respectively in preferably continuous welds 21 extending parallel to the folds 15 and 16 (as shown in FIG. 12).

The folded sheet 12 is then severed on a line 22 extending between and equi-distant from the folds 15 and 16 (as shown in FIG. 13) to provide two continuous webs 23 and 24.

Finally, each of the folded webs 23 and 24 is then heat sealed and severed transversely in a single operation at longitudinally spaced intervals (as shown at 25 in FIG. 14), thereby providing a series of identical bags cut from each web, each of the bags having a cross section similar to that illustrated in FIG. 2.

The synthetic plastics material, of which the bags above are made, may be polythene of 62.5 mym. However, it will be appreciated that other suitable synthetic plastics material may be used.

I claim:

1. A bag formed of a pliable material, comprising:

front and back panels joined along a fold defining the bottom of the bag and sealed together along respective adjoining side margins with an open mouth opposite said bottom;

said front panel being folded upon itself along a fold horizontal to said mouth and sealed along the side portions to form an external pouch, said flap being joined with said front panel by a seal extending transversely across said front panel between said mouth defining fold and the end of said pouch to form an enclosed portion; and said bag being adapted to be closed by folding said pouch about said transverse seal to form a hood over said mouth whereby said enclosed portion engages and deforms said back panel to form a barrier inside said hood.

2. A bag as in claim 1 wherein the top of said back panel and said folded front panel are substantially the same height.

3. A bag as in claim 1 wherein the top of said pouch extends above the top of said back panel.

4. A bag formed of a pliable material, comprising:

front and back panels joined along a fold defining the bottom of the bag and sealed together along respective adjoining side margins with an open mouth opposite said bottom;

said front panel being folded upon itself along a fold horizontal to said mouth and sealed along the side portions to form an external pouch, said flap being joined with said front panel by a seal extending transversely across said front panel between said mouth defining fold and the end of said pouch to form an enclosed portion; and when said bag being in a closed condition said pouch being folded about said transverse seal to form a hood over said mouth and said enclosed portion engaging and deforming said back panel to form a barrier inside said hood.

* * * * *